United States Patent [19]

Olson et al.

[11] 3,970,571

[45] July 20, 1976

[54] METHOD FOR PRODUCING IMPROVED ELECTROGRAPHIC DEVELOPER

[75] Inventors: James R. Olson, Rochester; Robert C. Storey, Penfield, both of N.Y.

[73] Assignee: Eastman Kodak Company, Rochester, N.Y.

[22] Filed: Dec. 20, 1974

[21] Appl. No.: 535,001

[52] U.S. Cl. ..... 252/62.1 P; 427/212; 427/215; 427/216; 427/220; 427/221; 427/289; 427/14

[51] Int. Cl.[2] ..... G03G 9/10

[58] Field of Search ..... 427/242, 289, 212, 215, 427/216, 220, 221, 14; 252/62.1 P, 62.1

[56] References Cited

UNITED STATES PATENTS

| | | | |
|---|---|---|---|
| 3,320,169 | 5/1967 | East et al. | 252/62.1 P |
| 3,672,928 | 6/1972 | Madrid et al. | 252/62.1 P |
| 3,725,118 | 4/1973 | Fuller et al. | 252/62.1 P |
| 3,740,334 | 6/1973 | Jacknow et al. | 252/62.1 P |
| 3,767,477 | 10/1973 | McCabe et al. | 427/216 X |
| 3,838,054 | 9/1974 | Trachtenberg et al. | 252/62.1 P |

OTHER PUBLICATIONS

Research Disclosure, Oct. 1972.

*Primary Examiner*—Mayer Weinblatt
*Assistant Examiner*—John D. Smith
*Attorney, Agent, or Firm*—George W. Neuner

[57] ABSTRACT

A method for preparing a preconditioned dry electrographic developer comprising the steps of: a) intimately mixing together an unconsolidated mass of carrier particles, and an unconsolidated mass of resin based toner particles containing charge control agent in greater concentration than desired in the final developer, the concentration of said toner in the resulting mixture being less than desired in the final developer, such mixing being for a sufficient length of time and in such a way as to pack any pores of said carrier particles with toner, to scum the surfaces of said carrier particles with charge control agent, and to abrade the surfaces of said carrier particles; and b) introducing into and intimately mixing with said resulting mixture an additional quantity of resin based toner particles containing charge control agent in about the same concentration as desired in the free toner in the final developer, said additional quantity together with the free toner present after step (a) bringing the concentration of free toner in the final mixture up to that desired in the final developer. Mixing desirably is accomplished by tumbling in a rotating container.

12 Claims, No Drawings

METHOD FOR PRODUCING IMPROVED ELECTROGRAPHIC DEVELOPER

BACKGROUND OF THE INVENTION

1. Field of the Invention

This invention relates to electrography, and to an improved dry electrographic developer composition which is useful in the development of electrostatic charge patterns. More particularly, the invention relates to a method for preparing an artifically aged or preconditioned dry electrographic developer having desirable characteristics which continue uniformly from the first prints through many thousands of prints. Previously available developers only attained such desirable characteristics after they had been aged in service, or if attained at the beginning of service, had tended to deteriorate as the number of prints increased. Developer produced by our novel method immediately provides prints which have image sharpness and image density which are superior to those produced with many previously available developers when first placed in service, which are equivalent in quality to those produced by many previously available developers after they have aged in service, e.g. after the preparation of several thousand prints, and which continue uniformly for many thousands of prints.

2. The Prior Art

Electrographic imaging and developing processes, and techniques, have been extensively described in both the patent and other literature, for example, U.S. Pat. Nos. 2,221,776 issued Nov. 19, 1940; 2,277,013 issued Mar. 17, 1942; 2,297,691 issued Oct. 6, 1942, 2,357,809 issued Sept. 12, 1944; 2,551,582 issued May 8, 1951; 2,825,814 issued Mar. 4, 1958; 2,833,648 issued May 6, 1958; 3,220,324 issued Nov. 30, 1965; 3,220,831 issued Nov. 30, 1965; 3,220,833 issued Nov. 30, 1965.

Generally these processes have in common the steps of forming an electrostatic charge pattern on an electrically insulating electrographic element, The electrostatic charge pattern is then rendered visible by a development step in which the charged surface of the electrographic element is brought into contact with a suitable developer mix. Conventional dry developer mixes include thermoplastic resin particles, known as toner particles, which may contain coloring agents, and may also include a carrier that can be either a magnetic material such as iron filings, powdered iron or iron oxide, or a triboelectrically chargeable, non-magnetic substance like glass beads or crystals of inorganic salts such as sodium or potassium fluoride. The toner typically comprises a resinous material, a colorant like dyestuffs or pigments such as carbon black, and may also contain other addenda such as plasticizers, charge control agents and the like.

One method for applying a suitable dry developer mix to a charged pattern-bearing electrographic element is by the magnetic brush process. Such a process generally utilizes an apparatus of the type described, for example, in U.S. Pat. No. 3,003,462 issued Oct. 10, 1961, which customarily comprises a non-magnetic rotatably mounted cylinder having fixed magnetic means mounted inside. The cylinder is arranged to rotate so that part of the surface is immersed in or otherwise contacted with a supply of developer mix. The granular mass comprising the developer mix is magnetically attracted to the surface of the cylinder. As the developer mix comes within the influence of the field generated by the magnetic means within the cylinder, particles arrange themselves in bristle-like formations resembling a brush. The brush formations that are formed by the developer mix tend to conform to the lines of magnetic flux, lying substantially flat in the vicinity of the poles, and standing erect when said mix is outside the environment of the magnetic poles. Within one revolution, the continually rotating cylinder picks up developer mix from a supply source and returns part or all of this material to this supply source. This mode of operation assures that fresh mix is always available to the surface of the charged electrographic element at its point of contact with the brush. In a typical rotational cycle, the roller performs the successive steps of developer mix pickup, brush formation, brush contact with the electrographic element, e.g. a photoconductive element, brush collapse, and finally developer mix release.

In magnetic brush development, as well as in various other types of electrographic development wherein a two-component dry triboelectric mixture of a particulate carrier and a toner powder are utilized, e.g., cascade development such as described in U.S. Pat. Nos. 2,638,416 and 2,618,552, it is advantageous to modify the surface properties of the toner powder so that a uniform, stable net electrical charge may be imparted to the toner powder by the particulate carrier.

One method of developer preparation has involved placing particles of a carrier and particles of toner (containing a charge control agent in the concentration desired in the final developer, generally about 0.1 to about 6 parts by weight per 100 parts of resin) in a container such as a churn, crock, cylinder or barrel, and then rotating the container on its longitudinal axis for a mixing period which generally is 24 hours or less. Then the developer is placed in the developer station of an electrophotographic apparatus and the printing process begins. Generally the prints gradually improve in pattern sharpness until about 10,000 prints have been made. There may also be a decrease in pattern density for the first 1,000 to 5,000 prints, followed by a gradual and desirable increase through the next 20,000 to 30,000 prints, after which pattern density remains essentially constant at a desirable density.

Pattern density varies significantly with changes in relative humidity when a fresh developer is used, but sensitivity to relative humidity changes decreases as the developer ages, in particular, the pattern density at low relative humidity increases.

Certain observations have been made concerning the possible causes for variations in developer performance. A decrease in pattern density occurs with increasing toner electrical charge. Toner charge, in turn, increases with decreasing average toner particle size and decreases with increasing carrier scumming (the physical transfer of toner components to the surfaces of the carrier particles).

The average particle size of free toner increases during the initial stages of mixing with porous carrier particles because the fine particles of toner pack or fill the void spaces of carrier particles. Also, the average toner particle size decreases rapidly in the early life of the developer in printing apparatus, because the printed patterns seem to be formed by a selection of the larger toner particles. As printing proceeds, the average particle size of toner particles in the developer charge approaches a value which is smaller than that in fresh developer, and smaller than that in any replenishing charge of toner which is added periodically.

The response of a toner concentration monitor is also sensitive to toner particle size variations. As the average particle size decreases, the carrier particle surface covered per unit weight of toner increases. This appears to the monitor as an effective concentration increase since the reflectance of the developer decreases, and the actual toner concentration decreases, Developer resistance changes occur as a result of a) toner particle size variations, b) attrition in carrier particle size by physical action during circulation in the developer system, and c) scumming of the carrier particles.

Toner throw-off is also related to toner charge level, particle size distribution, and changes in surface characteristics of the carrier particles.

SUMMARY OF THE INVENTION

In accordance with the present invention, an artificially aged or preconditioned dry electrographic developer is prepared in accelerated fashion, so as to simulate the characteristics of a normally aged developer, by the steps of:

a. Combining an unconsolidated mass of finely divided carrier particles and an unconsolidated mass of suitable finely divided resin based toner particles containing a suitable charge control agent in substantially greater concentration than is desired in the final developer, advantageously about 6 times as great. For example, about 2.0 to about 24% by weight of charge control agent based on the toner weight can be used, whereas the free toner in the final developer will contain about 1%. Higher levels may result in excessive scumming of the carrier particles, too low toner charge, and excessive pattern density.

The concentration of toner in the resulting carrier-toner mixture should be less than that desired in the final developer, which is generally about 1 to 10% by weight. An optimum toner concentration for this step is about 1.0% by weight, but 0.75 to 1.25% is a suitable range. Above the upper limit of 1.25%, the carrier particles are cushioned by toner so that a desired selective and controlled abrasion of carrier particles is prevented. Below the lower limit there will be insufficient scumming of the carrier particles with toner components, and excessive abrasion of the carrier particles. Various charge control agents can be used, but we prefer onium salts and ethoxylated amines, as described hereinafter.

b. Intimately mixing together the combined ingredients. This is accomplished advantageously by tumbling the mixture of carrier particles and toner particles as in a sealed container such as a barrel, churn, crock or cylinder which is rotated on its longitudinal axis for a sufficient length of time to scum the surfaces of the individual carrier particles with charge control agent as a consequence of the high concentration of charge control agent; as well as to accelerate abrading the surfaces of the carrier particles by rubbing against one another as a consequence of the low concentration of toner particles in the mixture, and to pack into pores of the carrier particles the smaller particles of toner. The duration of tumbling may range from a few hours to a few days, with particularly good results generally being obtained in a period of 12 to 24 hours, particularly about 24 hours. Beyond 24 hours e.g., 48 hours, it has been found that there is little increased benefit, but no deleterious effect.

c. After step (b) is completed, tumbling is stopped and there is introduced into the container an additional quantity of toner particles containing the same charge control agent in the same concentration as desired in the free toner in the final developer, which is about as would be present in a normally aged developer, for example 1/2 to 2%, advantageously about 1% by weight. The amount of addition may be between 1 and 3% by weight based on the carrier, and is such that the additional charge control agent, when combined with the charge control agent of the toner in the first operation (a), provides the concentration of charge control agent that is desired in the final developer. Also, the additional toner, when combined with toner in the first operation (a), is in a sufficient amount to bring the concentration of toner in the final mixture up to that desired in the final developer. The particle size distribution of the added toner in step (c) is such that the resulting toner particle size distribution is about the same as the equilibrium distribution in a normally aged developer of the prior art after several thousand electrographic prints have been made.

d. After introduction of the additional toner particles in step (c), the mixture is again tumbled by rotating the sealed container on its longitudinal axis for a period long enough to provide intimate mixing and uniform distribution, but without further abrading of carrier particles by one another (as they are now cushioned by toner). This period may range from as low as one hour with some charge control agents to as long as 24 hours with others, the main determinant being the length of time required to disperse the toner over the carrier particle surfaces.

The pore packing process, in which the fine toner particles enter and remain in the pores of the carrier particles in steps (a) and (b) removes most of the initial toner of steps (a) and (b) from circulation so that the charge control agent level in the final preconditioned developer of step (d) is only slightly higher than that of a normally aged developer.

Developer powder produced by steps (a) to (d) as described above provides improved quality of prints very early in the life of the developer, and improved uniformity of image quality throughout the developer life.

DESCRIPTION OF THE PREFERRED EMBODIMENTS

The carrier particles of this invention can be selected from a variety of materials, porous or non-porous, and generally range in size between 30 and 700 micrometers as determined by sieving with U.S. Standard sieves and conveting mesh sizes to micrometers, (preferably between 70 and 200, and even more usually between 105 and 177). Carriers include various nonmagnetic particles such as glass beads, crystals of inorganic salts such as sodium or potassium chloride, hard resin particles, metal particles, etc. In addition, magnetic carrier particles can be used in accordance with the invention. Suitable magnetic carrier particles are particles of ferrmagnetic materials such as iron, cobalt, nickel, and alloys and mixtures thereof. Especially desirable are porous iron particles having oxidized surfaces such as those produced by the methods of U.S. Pat. Nos. 3,632,512 and 3,767,477, or by acid washing, or by acid washing and nickel cladding of particles. Such porous particles can be packed in their pores with toner particles, thus altering the toner size distribution in the remaining free toner in the developer mass much as occurs in a naturally aged developer. However, benefits of the invention are realized even with non porous carrier particles. Even though the porepacking phenomenon may not occur, the non porous particles are scummed with charge control agent, and are abraded by rubbing against one another.

Other useful magnetic carriers are ferromagnetic particles overcoated with a thin layer of various film-forming resins, for example, the alkali-soluble carboxylated polymers described in Miller, U.S. Pat. No. 3,547,822 issued Dec. 15, 1970; Miller, U.S. Pat. No. 3,632,512 issued Jan. 4, 1972; McCabe, U.S. Pat. No. 3,795,617, issued Jan. 3, 1974; Kasper et al, U.S. Ser. No. 236,584, filed Mar. 21, 1972, entitled "Electrographic Carrier Vehicle and Developer Compositon — Case C" Now abandoned, divided and refiled as U.S. Ser. No. 389,839, filed Aug. 20, 1973 and U.S. Ser. No. 389,840, filed Aug. 20., 1973, which is now issued into U.S. Pat. No. 3,898,170; and Kasper's U.S. Pat. No. 3,795,618, issued Jan. 3, 1974. Other useful resin coated magnetic carrier particles include carrier particles coated with various fluorocarbons such as polytetrafluoroethylene, polyvinylidene fluoride, and mixtures thereof including copolymers of vinylidene fluoride and tetrafluoroethylene.

The resins useful for the toners in the practice of the present invention can be used alone or in combination, and include those resins conventionally employed in electrostatic toners. Useful resins generally have a glass transition temperature within the range of from 60° to 120°C. Preferably toner particles prepared from these resinous materials have a relatively high caking temperature, for example, higher than about 55°C, so that the toner powders may be stored for relatively long periods of time at fairly high temperatures without having individual particles agglomerate and clump together. The melting point of useful resins preferably is within the range of from about 65°C to about 200°C so that the toner particles can readily be fused to conventional paper receiving sheets to form a permanent image. Especially preferred resins are those having a melting point within the range of from about 65°C to about 120°C. Of course, where other types of receiving elements are used, for example, metal plates such as certain printing plates, resins having a melting point and glass transition temperature higher than the values specified above may be used.

As used herein, the term "melting point" refers to the melting point of a resin as measured by Fisher Johns apparatus, Fisher Scientific Catalog No. 12–144. Glass transition temperature (Tg), as used herein, refers to the temperature at which a polymeric material changes from a glassy polymer to a rubbery polymer. This temperature (Tg) can be measured by differential thermal analysis as disclosed in Techniques and Methods of Polymer Evaluation, Vol. 1, Marcel Dekker, Inc., N.Y. 1966.

Among the various resins which may be employed in the toner particles of the present invention are polystyrene, polyurethane, polycarbonates, resin modified maleic alkyd resins, polyamides, phenol-formaldehyde resins and various derivatives thereof, polyester condensates, modified alkyd resins and the like, aromatic resins containing alternating methylene and aromatic units such as described in Merrill et al U.S. Pat. No. 3,809,554, issued May 7, 1974, and the like.

Typical useful toner resins include certain polycarbonates such as those described in U.S. Pat. No. 3,694,359 issued Sept. 26, 1972, and which includes polycarbonate materials containing an alkylidene diarylene moiety in a recurring unit and having from 1 to about 10 carbon atoms in the alkyl moiety. Other useful resins having the above-described physical properties include polymeric esters of acrylic and methacrylic acid such as poly(alkylacrylate) including poly(alkylmethacrylate) wherein the alkyl moiety can contain from 1 to about 10 carbon atoms. Additionally, other polyesters having the aforementioned physical properties are also useful. Among such other useful polyesters are copolyesters prepared from terephthalic acid including subsituted terephthalic acid, a bis(hydroxyalkoxy) phenylalkane having from 1 to 4 carbon atoms in the alkoxy radical and from 1 to 10 carbon atoms in the alkane moiety and including such halogen substituted alkanes, and an alkylene glycol having from 1 to 4 carbon atoms in the alkylene moiety.

Other useful resins are various styrene-containing resins. Such polymers typically comprise a polymerized blend of from about 40 to about 100 percent by weight of styrene, from about 0 to 45 percent by weight of a lower alkyl acrylate or methacrylate having from 1 to about 4 carbon atoms in the alkyl moiety such as methyl, ethyl, isopropyl, butyl, etc. and from about 5 to about 50 percent by weight of another vinyl monomer other than styrene, for example, a higher alkyl acrylate or methacrylate having from about 6 to 20 or more carbon atoms in the alkyl group. A typical styrene-containing resin prepared from a copolymerized blend as described hereinabove is a copolymer prepared from a monomeric blend of 40 to 60 percent by weight styrene or styrene homolog, from about 20 to about 50 percent by weight of a lower alkyl acrylate or methacryalte and from about 5 to about 30 percent by weight of a higher alkyl acrylate or methacrylate such as ethylhexyl acrylate. A variety of other useful styrene containing toner materials are disclosed in the following U.S. Pat. Nos.: 2,917,460 issued Dec.15, 1959; Re. 25,136 issued Mar. 13, 1962; 2,788,288 issued Apr. 9, 1957; 2,638,416 issued Apr. 12, 1953; 2,618,552 issued Nov. 18, 1952; and 2,659,670 issued Nov. 17, 1953.

The toner particles which are used in the present invention can be prepared by various methods. One convenient technique for preparing these toners is spray-drying. Spray-drying involves dissolving the polymer in, and adding the toner colorant and charge control agent to, a volatile organic solvent such as dichloromethane. This solution is then sprayed through an atomizing nozzle using a substantially nonreactive gas such as nitrogen as the atomizing agent. During atomization, the volatile solvent evaporates from the airborne droplets, producing toner particles of the uniformly dyed or pigmented resin. The ultimate particle size is determined by varying the size of the atomizing nozzle and the pressure of the gaseous atomizing agent. Particles of a diameter between about 0.1 micrometers and about 100 micrometers may be used, although present day office copy devices typically employ particles between about 1.0 and 30 micrometers. However, larger particles or smaller particles can be used where desired for particular methods of development or particular development conditions. For example, in powder cloud development such as described in U.S. Pat.

No. 2,691,345 issued Oct. 12, 1954, extremely small toner particles are used.

Another convenient method for preparing the toner composition of the present invention is melt-blending. This technique involves melting a powdered form of polymeric resin and mixing it with suitable colorants, such as dyes or pigments, and the charge control agent. The resin can readily be melted on heated compounding rolls which are also useful to stir or otherwise blend the resin and addenda so as to promote the complete intermixing of these various ingredients. After thorough blending, the mixture is cooled and solidified. The resultant solid mass is then broken into small particles and finely ground to form a free-flowing powder of toner particles. These particles typically have an average particle size or average diameter within the range of from about 0.1 to about 100 micrometers.

The charge control agent can be a quaternary ammonium salt which is incorporated in a dry, particulate toner composition, as described above, comprising a resin, and, if desired, a suitable colorant such as a pigment or dye. This agent can be added in an amount between 0.5 and 6.0 parts per hundred parts of resin, by weight; preferably 1 part charge agent per 100 parts of resin, which is 0.93% by weight of total toner; actual analysis showed 0.83%. Typical of the quaternary ammonium salts useful as charge control agents are materials having the following formula:

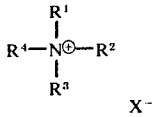

wherein $R^1$, $R^2$, $R^3$, and $R^4$, which may be the same or different, represent an aliphatic hydrocarbon group having seven or less, preferably 3 to 7, carbon atoms, including straight-chain and branched-chain aliphatic hydrocarbon groups, and $X^-$ represents an anionic function. Toner compositions containing such salts are described and claimed in U.S. Pat. No. 3,893,935 issued July 8, 1975 the disclosure of which is incorporated by reference herein.

The quaternary ammonium salt charge control agents, when incorporated in the toner materials of the present invention, have been found surprisingly effective in providing a particulate toner composition which exhibits a relatively high, uniform and stable net toner charge when admixed with a suitable particulate carrier vehicle, and which also exhibits a minimal amount of deleterious toner throwoff. This charge control agent has been found substantially more effective than the long-chain quaternary ammonium surfactant materials which previously have been incorporated in toner compositions. More specifically, the quaternary ammonium salts described above have been found to exhibit a substantially higher net toner charge and a substantially lower toner throw-off than long-chain quaternary ammonium salt surfactants (or wetting agents as they are sometimes called). In addition, quaternary ammonium charge control agents described above have been found to have no deleterious effect on the adhesion properties of the resultant toner composition to conventional paper receiving sheets.

Furthermore, toners containing quaternary ammonium salts as described above exhibit substantially better "charge control" properties than toner compositions containing other types of onium salts, e.g., sulfonium, phosphonium, pyridinium, or quinolinium salts.

Moreover, it has been found that particulate resinous toner particles containing an effective amount of the above described quaternary ammonium charge control agents generally result in good-to-excellent electrographic developed patterns exhibiting increased and uniform density with little or no background scumming of the receiver sheets, particularly after preconditioning by the method of the present invention.

Still another charge control agent which is useful in toners which are used for preparing a preconditioned developer in accordance with the method of the present invention, is an ethoxylated amine such as one of those available from the Armak Chemical Corporation under the trademark Ethomeen, as described in U.S. application Ser. No. 470,425 filed May 16, 1974 by T. A. Jadwin and R. C. Storey, the disclosure of which is incorporated by reference herein. Such compositions are ethylene oxide condensation products of primary fatty amines, and the ones which offer the greatest utility in this invention are those of the formula:

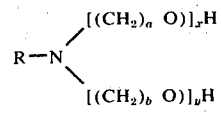

wherein a and b represent integers of from about 2 to 4 and may be the same or different, $x$ and $y$ represent integers of from about 1–10 and may be the same or different, and R is an alkyl group containing from about 8 to about 30 carbon atoms.

This agent can be added in an amount between 0.5 and 5.0 parts per hundred parts of polymeric resin, by weight; preferably 1 part charge agent per hundred parts resin, which is 0.943% by weight of total toner; actual analysis showed 0.90%. Adequate mixing in the fourth step (b) requires tumbling for only about 1 hour, but the second step (d) requires 12 hours or more, e.g., 12-24hours.

The toner compositions utilized in the present invention may or may not contain a colorant such as a dye or carbon black, which is dissolved or mixed into the resin for producing the desired final color which normally is black.

The invention is further illustrated by the following examples of its practice.

EXAMPLE 1

A cylinder, 6 ¾ inches in diameter by 6 ½ inches in length, was charged with 8.82 pounds of resin-coated porous iron particles as carrier, and 0.089 pound (about 1%) of polystyrene-based toner particles containing 2.62% by weight of tetrapentyl ammonium chloride as charge control agent. The porous iron particles had oxidized surfaces produced in accordance with U.S. Pat. No. 3,767,477, and were coated with Kynar polyvinylidene fluoride resin. The resulting mixture was tumbled in a first mixing step for 24 hours by rotating the cylinder about its longitudinal axis. The amount of free toner the present was 0.22%, the other 0.78% having packed into the pores of the carrier particles.

Before tumbling, the toner had the following size distribution:

| Class Interval micrometers | Percent of Total Number of Particles |
|---|---|
| 1.00 – 1.26 | 9.13 |
| 1.26 – 1.59 | 3.94 |
| 1.59 – 2.00 | 3.01 |
| 2.00 – 2.52 | 3.25 |
| 2.52 – 3.17 | 4.01 |
| 3.17 – 4.00 | 6.70 |
| 4.00 – 5.04 | 11.44 |
| 5.04 – 6.35 | 18.13 |
| 6.35 – 8.00 | 20.76 |
| 8.00 – 10.08 | 14.12 |
| 10.08 – 12.70 | 4.58 |
| 12.70 – 16.00 | 0.80 |
| 16.00 – 20.20 | 0.10 |
| 20.20 – 25.40 | 0.02 |
| >25.4 | 0.00 |

After 24 hours of tumbling, the cylinder was stopped and there was added to the mixture in the cylinder 0.207 pound of polystyrene-based toner particles containing only 0.88% by weight of tetrapentyl ammonium chloride, for a second mixing step.

The special toner particle size distribution for the second mixing step was obtained by mixing toners with the following distributions:

| Class Interval micrometers | Percent of Total Number of Particles | | |
|---|---|---|---|
| | Toner "b" | Toner "c" | Toner "d" |
| 1.00 – 1.26 | 16.95 | 6.56 | 8.13 |
| 1.26 – 1.59 | 16.92 | 4.21 | 1.84 |
| 1.59 – 2.00 | 17.37 | 4.03 | 1.36 |
| 2.00 – 2.52 | 16.45 | 4.36 | 2.14 |
| 2.52 – 3.17 | 13.69 | 5.87 | 3.94 |
| 3.17 – 4.00 | 10.01 | 11.46 | 7.73 |
| 4.00 – 5.04 | 5.82 | 22.68 | 12.07 |
| 5.04 – 6.35 | 2.29 | 30.41 | 17.20 |
| 6.35 – 8.00 | .35 | 9.92 | 17.20 |
| 8.00 – 10.08 | .05 | .48 | 15.64 |
| 10.08 – 12.70 | .04 | .02 | 9.75 |
| 12.70 – 16.00 | .04 | .00 | 2.62 |
| 16.00 – 20.20 | .01 | .00 | .33 |
| 20.20 – 25.04 | .01 | .00 | .02 |
| >25.4 | .00 | .00 | .00 |

These toners were added in the ratio of b/c/d = 1/11.87/4.34 to the developer in a total amount required to bring the toner concentration in the working developer to 3.25% from the initial 1%. The sum of the various particle size distributions of the first and second mixing steps then resembled the distribution of a normally aged developer of acceptable reproduction characteristics.

After tumbling for 24 hours more, the developer was removed and analyzed for concentration of free toner (2.25%). The free toner content of the developer had the following size distribution:

| Class Interval micrometers | Percent of Total Number of Particles |
|---|---|
| 1.00 – 1.26 | 5.92 |
| 1.26 – 1.59 | 1.42 |
| 1.59 – 2.00 | 0.98 |
| 2.00 – 2.52 | 0.87 |
| 2.52 – 3.17 | 1.72 |
| 3.17 – 4.00 | 7.42 |
| 4.00 – 5.04 | 21.88 |
| 5.04 – 6.35 | 37.03 |
| 6.35 – 8.00 | 16.23 |
| 8.00 – 10.08 | 3.67 |
| 10.08 – 12.70 | 1.98 |
| 12.70 – 16.00 | 0.73 |
| 16.00 – 20.20 | 0.10 |
| 20.20 – 25.90 | 0.02 |

-continued

| Class Interval micrometers | Percent of Total Number of Particles |
|---|---|
| >25.9 | 0.00 |

The developer was then placed in an electrophotographic printing apparatus and prints on plain paper were produced. Substantially constant pattern density was obtained over a run of 100,000 prints. Also, all prints from beginning to end had acceptable sharpness.

During part of the run, the relative humidity was reduced from 75% down to 15%, with no deterioration of pattern density.

EXAMPLE 2

A cylinder, 6 ¾ inches in diameter by 6 ½inches in length, was charged with 8.82 pounds of resin-coated porous iron particles as carrier (the same as in Example 1), and 0.089 pound of toner particles consisting of 100 parts by weight of poly(styrene-co-methyl methacrylate-co-ethylhexyl methacrylate-co-divinyl benzene) resin, 3.0 parts by weight of Ethomeen (trademark) 18/12 (an ethylene oxide condensation product of a primary fatty amine sold by Armak Chemical Corporation), and 5 parts by weight of carbon black. Before tumbling the mixture had essentially the same size distribution as in Example 1. This mixture was tumbled for 24 hours.

Then tumbling was stopped and there was added to the mixture in the cylinder 0.207 pound of toner particles which were the same as described above except that they contained only 0.94% by weight of Ethomeen 18/12. After tumbling for 1 hour more, the developer was removed and placed in an electrophotographic printing apparatus and prints on plain paper were produced. Substantially constant pattern density was secured over a run of 100,000 prints, and acceptable sharpness of prints was obtained.

REPLENISHMENT

The preaged or preconditioned toner produced by our novel method operates to produce excellent prints initially as well as subsequently. After a time, enough toner has been extracted from the developer that replenishment with additional toner becomes necessary. This is accomplished by adding to the mass of developer in the reproduction apparatus a quantity of toner having the same composition as the toner in the second mixing step described above, including the same level of charge agent. The particle size distribution of the replenisher toner is the same as that of toner "d" in the original developer. An equilibrium is established by the interaction of developer and replenisher over a long print run to assure continued acceptable print quality.

From the foregoing description, it is evident that there has been provided a novel, useful and unobvious method for preparing an electrographic developer whose desirable characterisitics resemble those of a developer which has been subjected to an extended period of use in a development mode.

The invention has been described in detail with particular reference to preferred embodiments thereof, but it will be understood that variations and modifications can be effected within the spirit and scope of the invention.

We claim:

1. A method for preconditioning a dry electrographic developer incorporating free toner particles prior to using such developer to develop images in an electrographic process, said method comprising the steps of:

a. intimately mixing together i. an unconsolidated mass of carrier particles, and ii. an unconsolidated mass of resin-based toner particles containing charge control agent in greater concentration than desired in free toner particles of the developer after preconditioning and for developing images in an electrographic process, to form a resulting mixture which includes at least some free toner particles but in a concentration which is less than desired in the developer after preconditioning and for developing images in an electrographic process, such mixing being for a sufficient length of time and in such a way as to pack any pores of said carrier particles with toner particles, to scum the surfaces of said carrier particles with charge control agent, and to abrade the surfaces of said carrier particles; and b. introducing into and intimately mixing with said resulting mixture an additional quantity of resin-based toner particles containing charge control agent to increase the concentration of free toner particles up to that desired in the developer after preconditioning and up to that desired for developing images in an electrographic process, the concentration of charge control agent in the additional quantity of toner particles being about the same as desired in the free toner particles of the developer after preconditioning and about the same as desired for developing images in an electrographic process; the total concentration of toner particles in the developer after preconditioning being in the range of about 1 to about 10% based on the weight of the carrier particles and the total amount of charge agent in the toner particles after preconditioning the developer being in the range of about 0.1 to about 6.0% based on the weight of the resin in the toner particles.

2. A method in accordance with claim 1 wherein the mixing of step (a) is accomplished by tumbling in a rotating container for 12 hours or more.

3. A method in accordance with claim 1 wherein said charge control agent in step (a) is an onium salt, in an amount between 2 and 24 parts per 100 parts resin by weight, and wherein mixing in each of steps (a) and (b) is done by tumbling for a period of 12 hours or more.

4. A method in accordance with claim 3 wherein said onium salt is tetrapentyl ammonium chloride.

5. A method in accordance with claim 1 wherein said charge control agent in step (a) is an ethoxylated primary fatty amine in an amount between 2 and 24 parts per 100 parts resin by weight, wherein mixing in step (a) is done by tumbling for 12 hours or more, and wherein mixing in step (b) is done by tumbling for about one hour or more.

6. A method in accordance with claim 1 wherein said carrier particles are porous iron particles coated with a resin.

7. A method in accordance with claim 1 wherein said carrier particles are metal clad.

8. A method in accordance with claim 1 wherein said carrier particles are porous iron particles having oxidized surfaces coated with resin and having a size between about 30 and 700 micrometers, and wherein said toner particles have a particle size between about 0.1 and 100 micrometers.

9. A method in accordance with claim 1, wherein in step (a) said toner particles are present in an amount between about 0.75 to 1.25% based on the weight of the carrier particles.

10. A method in accordance with claim 9 wherein said toner particles in step (a) contain about 2 to 24% by weight of charge control agent.

11. A method in accordance with claim 1 wherein in step (b) said additional toner contains about 0.5 to 2% by weight of charge control agent.

12. A method in accordance with claim 11 wherein said additional toner is in an amount between about 1 and 3% by weight based on said carrier.

* * * * *